US009915148B2

(12) United States Patent
Cheyne et al.

(10) Patent No.: US 9,915,148 B2
(45) Date of Patent: Mar. 13, 2018

(54) MINERAL WINNING PICK, HOLDER, AND COMBINATION

(71) Applicant: ESCO Corporation, Portland, OR (US)

(72) Inventors: Mark Alexander Cheyne, Gresham, OR (US); Jack Charles Rickey, Vancouver, WA (US)

(73) Assignee: ESCO Corporation, Portland, OR (US)

( * ) Notice: Subject to any disclaimer, the term of this patent is extended or adjusted under 35 U.S.C. 154(b) by 0 days.

(21) Appl. No.: 15/009,303

(22) Filed: Jan. 28, 2016

(65) Prior Publication Data

US 2016/0215619 A1 Jul. 28, 2016

Related U.S. Application Data

(60) Provisional application No. 62/108,675, filed on Jan. 28, 2015.

(51) Int. Cl.
*E21C 35/18* (2006.01)
*E21C 35/19* (2006.01)

(52) U.S. Cl.
CPC ..... *E21C 35/19* (2013.01); *E21C 35/18* (2013.01); *E21C 2035/1826* (2013.01)

(58) Field of Classification Search
CPC .. E21C 35/18; E21C 2035/1826; B28D 1/188
See application file for complete search history.

(56) References Cited

U.S. PATENT DOCUMENTS

| | | | | |
|---|---|---|---|---|
| 1,140,173 | A | 5/1915 | Levin | |
| 1,375,638 | A | 4/1921 | Kienzle | |
| 1,916,463 | A | 7/1933 | Carrel | |
| 2,658,740 | A | 11/1953 | Dann | |
| 2,722,410 | A | 11/1955 | Brown | |
| 3,097,547 | A | 7/1963 | Krekeler | |
| 3,114,537 | A | 12/1963 | Krekeler | |
| 3,174,802 | A | 3/1965 | Proctor | |
| 3,256,043 | A | 6/1966 | Krekeler | |
| 3,342,531 | A * | 9/1967 | Krekeler | E21C 35/19 175/413 |
| 3,606,471 | A | 9/1971 | Evans | |
| 3,834,764 | A | 9/1974 | Krekeler | |
| 3,856,358 | A | 12/1974 | Krekeler | |
| 3,913,979 | A | 10/1975 | Strauss et al. | |
| 3,991,976 | A | 11/1976 | Skinner | |

(Continued)

FOREIGN PATENT DOCUMENTS

| | | |
|---|---|---|
| DE | 7823740 | 11/1978 |
| FR | 1539737 | 9/1968 |

(Continued)

*Primary Examiner* — John J Kreck
*Assistant Examiner* — Michael A Goodwin
(74) *Attorney, Agent, or Firm* — Steven P. Schad

(57) ABSTRACT

A pick for mineral winning includes an elongate shank configured to be positioned into a cavity of a holder. A profile is defined on an outside surface of the shaft which includes a first surface formed into the profile and disposed to receive a leveraging device to enable a first forced translational movement of the shaft relative to the holder, and a second surface formed into the profile and disposed to receive the leveraging device to enable a second forced translational movement of the shaft relative to the holder.

4 Claims, 10 Drawing Sheets

(56) References Cited

U.S. PATENT DOCUMENTS

| | | | | |
|---|---|---|---|---|
| 4,084,856 | A | 4/1978 | Emmerich et al. | |
| 4,143,920 | A | 3/1979 | Haddock | |
| 4,149,753 | A | 4/1979 | Stoltz et al. | |
| 4,154,483 | A | 5/1979 | Hollingworth | |
| 4,161,310 | A | 7/1979 | Parker | |
| 4,261,619 | A | 4/1981 | Howe et al. | |
| 4,298,233 | A | 11/1981 | Elfgen | |
| 4,480,874 | A | 11/1984 | Shaw | |
| 4,536,037 | A | 8/1985 | Rink | |
| 4,609,227 | A | 9/1986 | Wild et al. | |
| 4,650,255 | A | 3/1987 | Staroba | |
| 4,880,247 | A | 11/1989 | Herridge | |
| 4,913,125 | A | 4/1990 | Bunting et al. | |
| 5,067,775 | A | 11/1991 | D Angelo | |
| 5,374,111 | A | 12/1994 | Den Besten et al. | |
| 5,681,030 | A | 10/1997 | Nall | |
| 6,176,552 | B1 | 1/2001 | Topka, Jr. et al. | |
| 6,331,035 | B1 | 12/2001 | Montgomery, Jr. | |
| 6,364,420 | B1 * | 4/2002 | Sollami | B28D 1/188 299/104 |
| 7,380,887 | B2 | 6/2008 | Latham | |
| 7,458,646 | B2 | 12/2008 | Marathe et al. | |
| 7,523,572 | B2 | 4/2009 | Pasqualini | |
| 7,635,168 | B2 | 12/2009 | Hall et al. | |
| 8,800,178 | B2 | 8/2014 | Rol Corredor et al. | |
| 2005/0097789 | A1 | 5/2005 | Asam et al. | |
| 2009/0108664 | A1 * | 4/2009 | Hall | E21C 35/197 299/104 |
| 2010/0320829 | A1 * | 12/2010 | Sollami | E21C 35/18 299/106 |
| 2012/0181845 | A1 * | 7/2012 | Sollami | B25B 23/0035 299/108 |
| 2013/0169023 | A1 | 7/2013 | Monyak et al. | |
| 2014/0175853 | A1 | 6/2014 | Warren | |
| 2014/0368022 | A1 | 12/2014 | Torres Delgado | |
| 2015/0035344 | A1 * | 2/2015 | Hall | E21C 35/18 299/113 |

FOREIGN PATENT DOCUMENTS

| | | |
|---|---|---|
| GB | 1579105 | 5/1978 |
| GB | 2182373 | 5/1987 |

* cited by examiner

MINERAL WINNING PICK, HOLDER, AND COMBINATION

RELATED APPLICATIONS

This application claims priority benefits to U.S. Provisional Patent Application No. 62/108,675 filed Jan. 28, 2015 and entitled "Mineral Winning Pick, Holder and Combination," which is incorporated herein by reference in its entirety.

FIELD OF THE INVENTION

The present invention pertains to a pick and holder, primarily for use in mineral winning, such as coal mining, but also useable for other underground purposes such as tunnel or roadway driving, or above ground for civil engineering works, such as road planing, trench cutting, both on land and sub-sea.

BACKGROUND OF THE INVENTION

In coal and other kinds of mining by the longwall technique, it is conventional for minerals to be removed by a single or double ended ranging shearer drum, which traverses the mineral face with a rotary cutting head carried by the, or each, ranging arm to follow the seam. Typically, each drum is provided with 50 or more cutting tools but it is possible for there to be fewer than 50 cutting tools. Holders are welded to the drum to support replaceable picks designed to engage the ground. In some constructions, each holder may contain a water spray for spraying the working end (i.e., the head) of the pick and the coal with water. In general, each pick comprises a pick shank, a securement mechanism to maintain the pick in the holder, a head, and a transition area between the head and the shank.

In use, the shearer drum is rotated about its central axis. As the drum rotates, the holders move about the axis with the drum so that the picks engage the ground. The water spray, if provided, sprays water on the pick and the coal to minimize dust and the risk of frictional ignitions.

When the pick contacts the wall while the shearer drum rotates, the picks experience forces as the pick breaks up the material to be excavated. Eventually the forces cause the pick to wear out or break. As the picks wear out or break they must be replaced. A pick is often replaced several times before the holder has been worn to a point that it too must be replaced.

Generally, when the pick needs to be replaced it must be pried or otherwise forced out of the holder. Picks are generally provided with a pry finger or other notch or a recess that can be engaged with a tool to pry the pick out of the holder. The pry tool generally bears against the holder as the tool pries the pick out of the holder. However, in some cases, the finger, notch, or recess does not provide sufficient leverage to remove the pick from the holder with relatively little force. When this occurs the operator must determine how to best remove the pick from the holder. Deviating from the standard process for removing the pick from the holder may increase the amount of downtime required for replacing the picks which in turn leads to a decrease in productivity. The operator may exert a large amount of force to remove the pick from the holder, but such action may cause the operator to be injured during the removal process. In an effort to remove the pick from the holder, the operator may use the tool to engage other surfaces on the pick or holder that are not designed as removal features. Engaging the pick or the holder in areas that are not designed for engagement with a removal tool also increases the likelihood that the operator may be injured (e.g., removal tool slippage) and/or that the holder may be damaged and need to be prematurely replaced. Damaged holders must be cut from the drum and new holders welded in their place. Because of the risk of frictional ignitions and tight dark working areas, typically, shearer drums are removed from service and moved to a safe location for refurbishment, for example to the surface. Moving the shearer drum, cutting the welds between the shearer drums and the holder, and welding new holders in place is time consuming. Such refurbishment can be lengthy and expensive. There is a need for a pick and holder assembly that can be easily and quickly separated when the pick needs replacement.

SUMMARY OF THE INVENTION

The present invention pertains to an improved pick and holder assembly for use in mineral winning and the like. With the present construction, a pick can be quickly and safely removed from the holder. Being able to quickly remove the pick from the holder translates to less downtime and greater productivity.

In accordance with one aspect of the invention, a pick is provided with multiple removal features that can be engaged with a removal tool to remove the pick from the holder. Providing multiple removal features on the pick allows the operator to engage multiple surfaces with the removal tool that are designed to appropriately support the removal tool and are designed to withstand the expected forces to be encountered during the removal process.

In accordance with another aspect of the invention, a pick including a shank and a head is provided with a plurality of pry surfaces that are each within a longitudinal extension of the shank.

In accordance with another aspect of the invention, a pick including a pick and a head is provided with a plurality of pry surface that are in successive alignment in a direction generally parallel to the longitudinal axis of the shank.

In accordance with another aspect of the invention, a pick is provided with multiple removal features linearly offset in planes generally perpendicular to the longitudinal axis of the shank. In one preferred construction, the multiple removal features are aligned in a direction generally aligned with the longitudinal axis of the shank of the pick. Having multiple removal features that are in-line with the axis of the shank minimizes the tendency that the shank will rock within the holder during the removal process to minimize jamming, or canting.

In accordance with another aspect of the invention, a pick is provided with multiple removal features that are in-line with each other. Having the removal features in-line with each other allows one surface on the holder to be designed as a bearing surface for engaging the removal tool during the removal process. In accordance with one preferred construction, the multiple removal features are successive. Having in-line successive removal features allows the removal tool to engage each removal feature one after the other.

In accordance with another aspect of the invention, a pick assembly includes a pick and a holder having an opening for receiving a pick, and the pick is provided with at least one removal feature that is in the opening of the holder when the pick is fully seated in the holder and is accessible outside of the holder by a removal tool once the pick has been partially removed from the holder. In one preferred construction, the removal feature is recessed in the pick. Recessing the feature in the pick allows the removal feature to be free of interference with the opening and better protects the removal features from wear.

In accordance with another aspect of the invention, a pick assembly is provided with a holder having an opening for receiving a pick and the pick is provided with a removal feature that is designed to be engaged with a removal tool once the holder has been worn such that the pick within the holder sits lower within the holder.

The aspects and embodiments noted above can be used together or separately. To gain an improved understanding of the advantages and features of the invention, reference may be made to the following descriptive matter and accompanying Figures that describe and illustrate various configurations and concepts related to the invention.

DETAILED DESCRIPTION OF THE PREFERRED EMBODIMENTS

Figure 4:
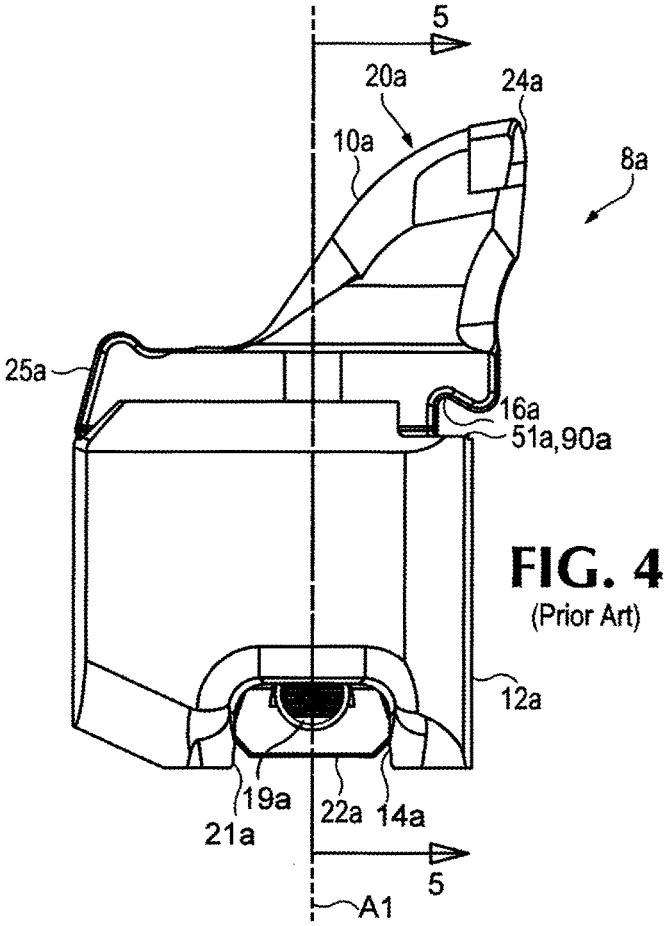
FIG. 4 (Prior Art)
FIG. 4 is a side view of the prior art pick assembly shown in FIG. 2.
Figure 5:
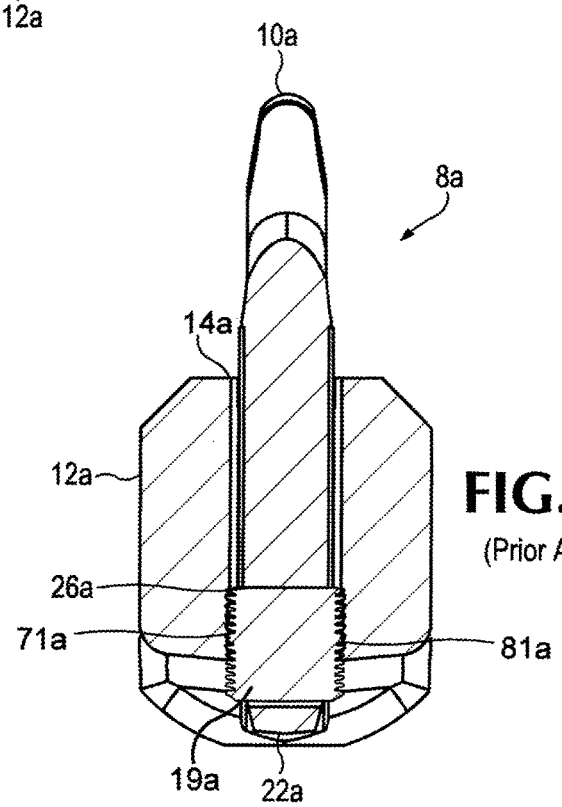
FIG. 5 (Prior Art)
FIG. 5 is a cross sectional view of the pick assembly shown in FIG. 2 taken along line 5-5 in FIG. 4.
Figure 6:
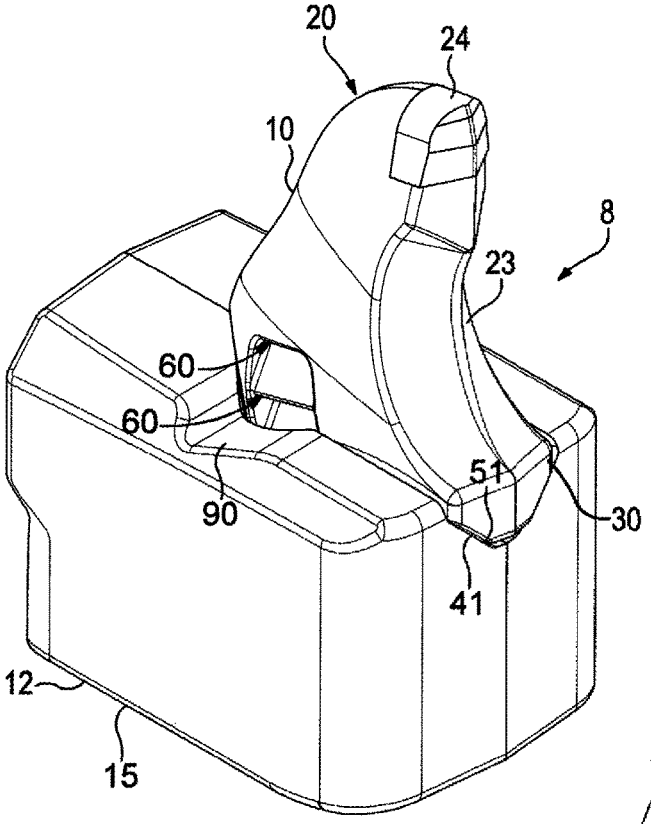
FIG. 6 is a front perspective view of a pick assembly of the present invention.
Figure 7:
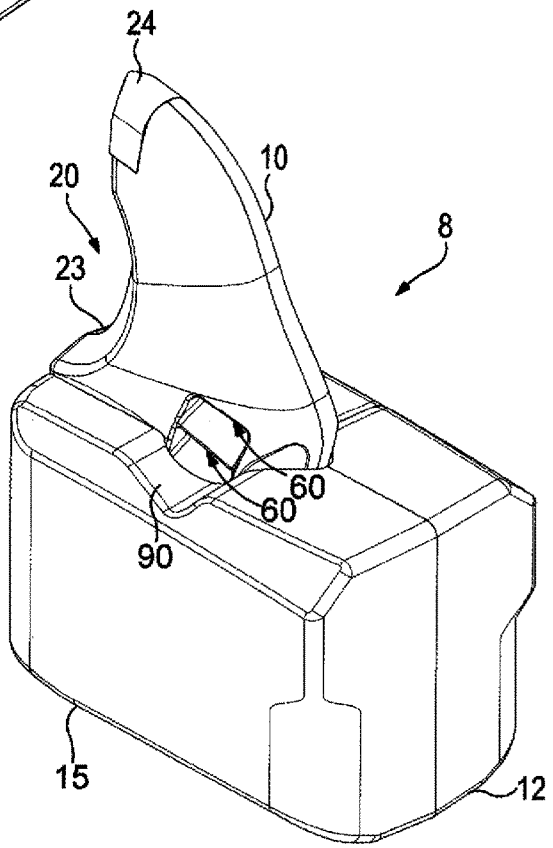
FIG. 7 is a rear perspective view of the pick assembly shown in FIG. 6.
Figure 8:
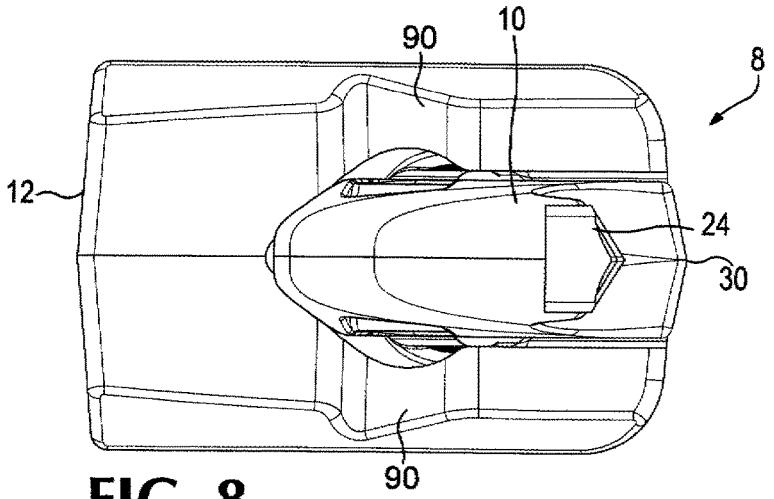
FIG. 8 is a top view of the pick assembly shown in FIG. 6.
Figure 9:
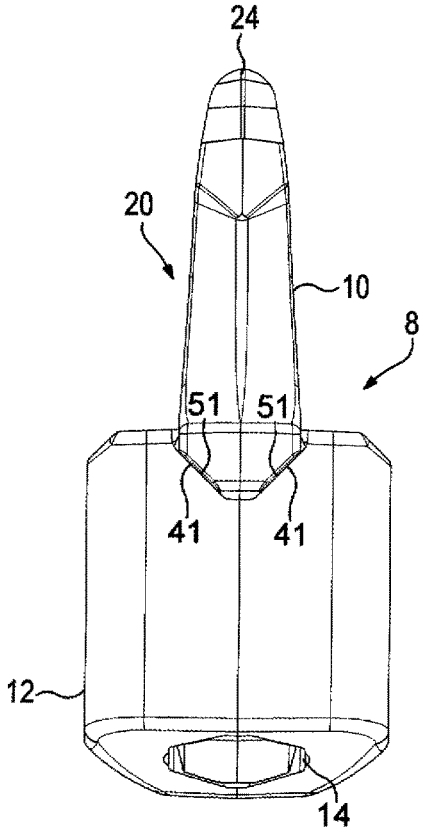
FIG. 9 is a front view of the pick assembly shown in FIG. 6.
Figure 10:
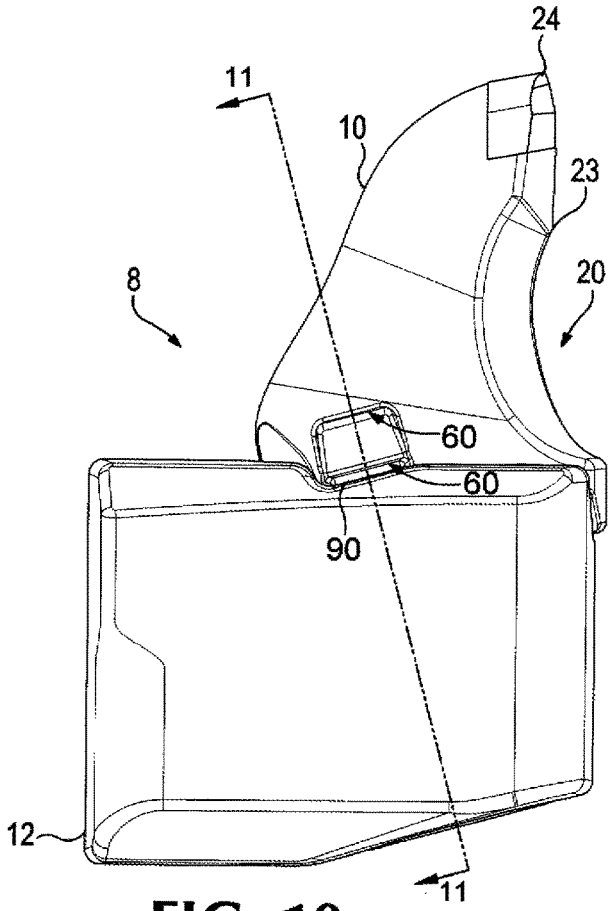
FIG. 10 is a side view of the pick assembly shown in FIG. 6.
Figure 15:
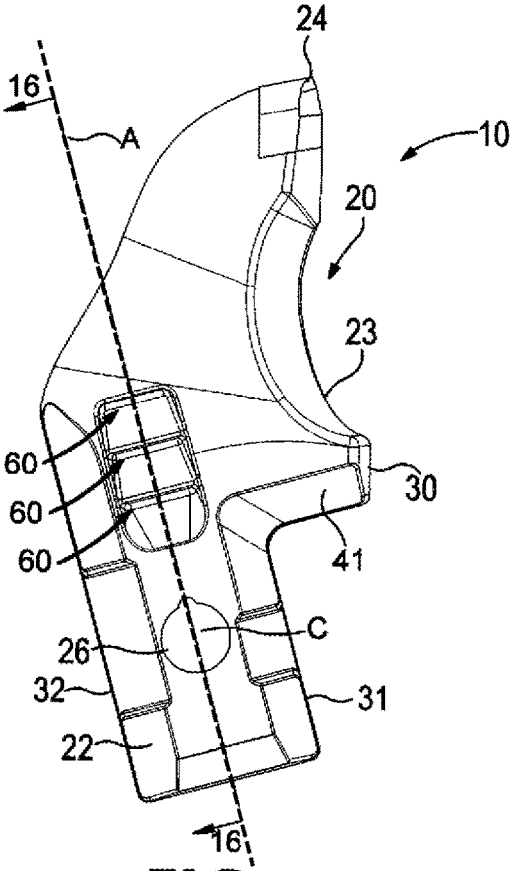
FIG. 15 is a side view of the pick shown in FIG. 6.
Figure 16:
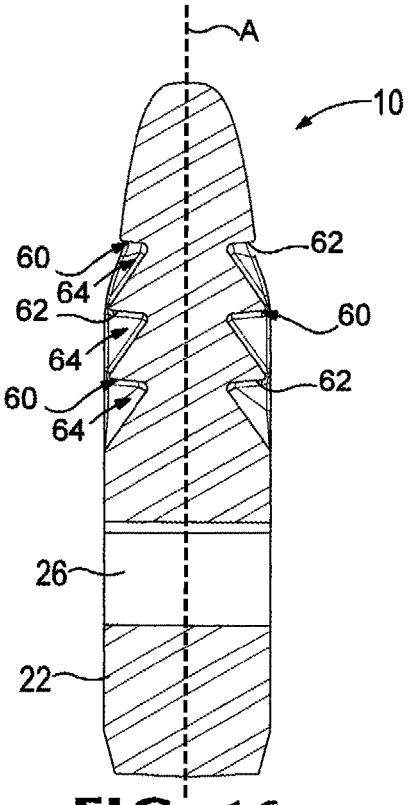
FIG. 16 is a cross sectional view of the pick shown in FIG. 6 taken along line 16-16 in FIG. 15.
Figure 17:
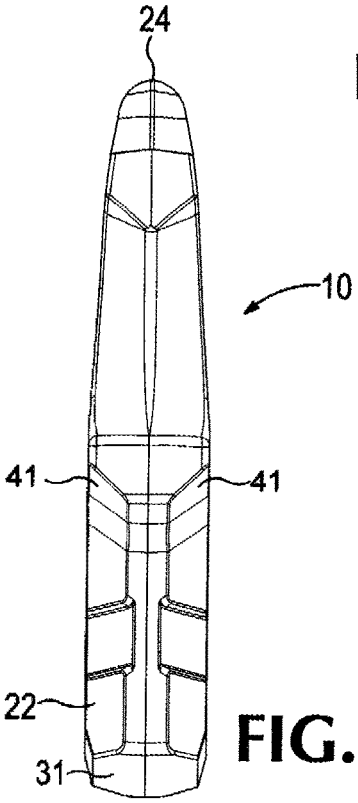
FIG. 17 is a front view of the pick shown in FIG. 6.

The present invention pertains to an improved pick and holder assembly for use, for example, in mineral winning in underground mining. Picks and holders can be used with a variety of applications including longwall shearer drums, continuous miner heads, and cutting chains. In this application, the invention is described in terms of a pick assembly for attachment to a shearer drum unless otherwise stated; nevertheless, the different aspects of the invention can be used in conjunction with other types of excavating applications. In this application, relative terms are at times used, such as front, rear, up, down, horizontal, vertical, etc., for ease of the description. Nevertheless, these terms are not considered absolute; the orientation of a pick and holder will change during operation. These relative terms should be understood with reference to the orientation of pick assembly as illustrated in FIGS. 4, 10, and 15 unless otherwise stated, i.e., wherein the pick and holder are in the uppermost position on the drum.

Figure 1:
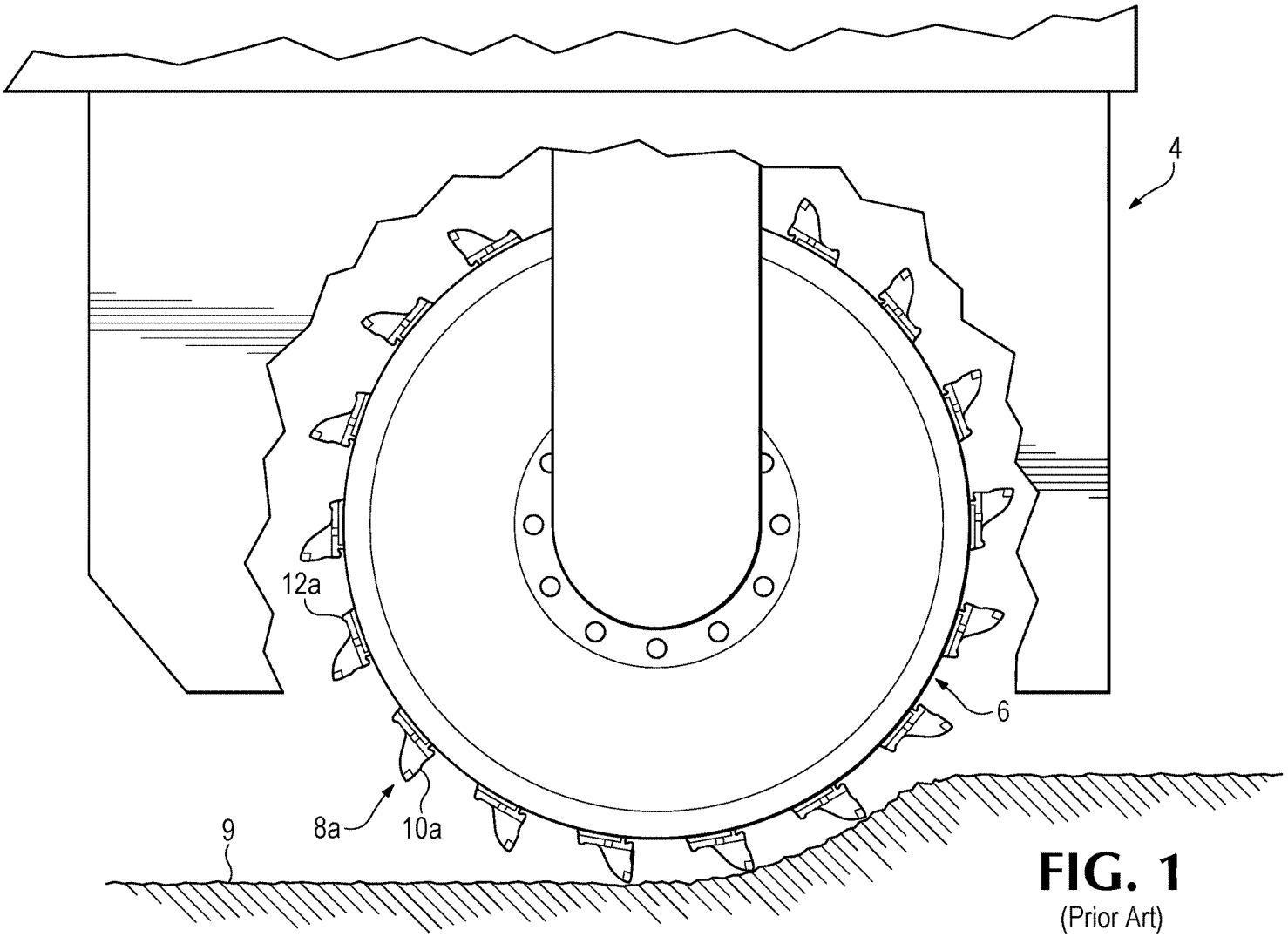
FIG. 1 (Prior Art)
FIG. 1 is a depiction of a prior art earth working operation including a roll with pick assemblies.
Figure 2:
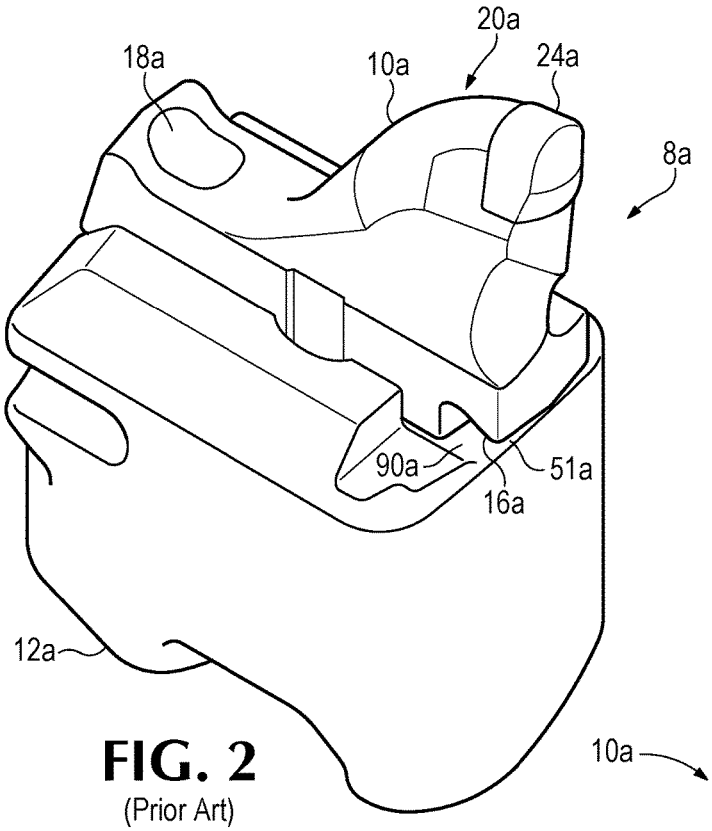
FIG. 2 (Prior Art)
FIG. 2 is a perspective view of a prior art pick assembly including the pick and holder.
Figure 3:
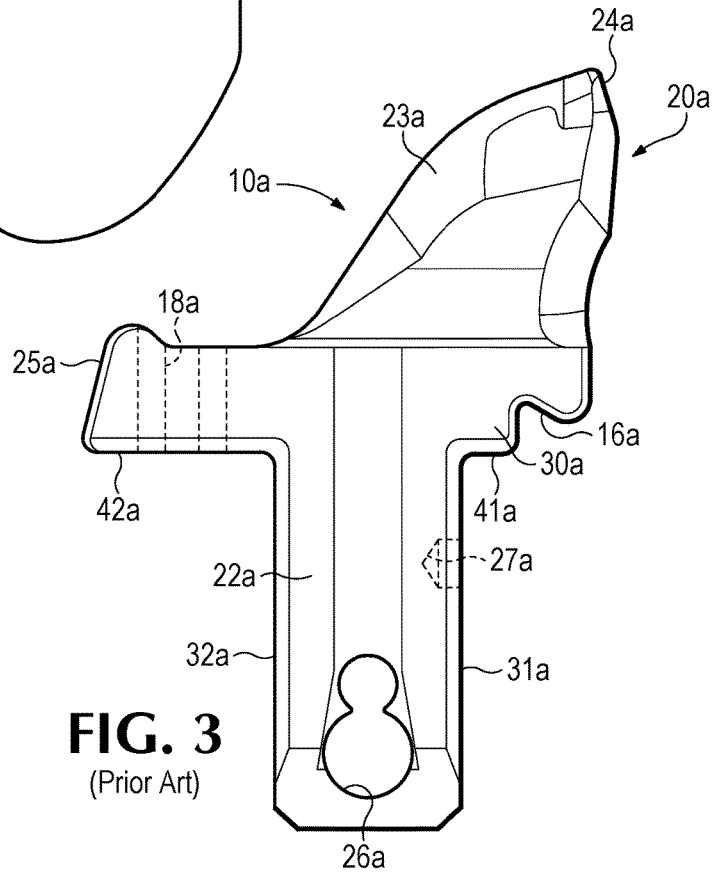
FIG. 3 (Prior Art)
FIG. 3 is a side view of the prior art pick shown in FIG. 2.

FIG. 1 depicts an earth working operation including a typical face miner with pick assemblies 8*a* for extracting earthen material such as coal in a mining operation. The operation is shown as including a mining machine 4 with a driven roll or drum 6 mounted with pick assemblies 8*a*. Pick assemblies 8*a* include a pick 10*a* for impacting the ore seam or earthen material 9 as drum 6 rotates and a holder 12*a* to support picks 10*a*. Picks 10*a* are mechanically secured to holders 12*a*, and holders 12*a* are welded in notches in drum 6.

Earthen material to be extracted is typically in a consolidated seam. The rotating drum 6 passes across the mine face so the picks impact the face and dislodges material from the seam in manageable portions.

Picks 10*a* impinge on the material with speed and force to fracture and separate the consolidated material. The spacing of the picks determines the size of the dislodged material, but also is a factor in stress on individual picks and heating of components. The mined material is typically dropped onto a conveyor and moved away for further processing. Pick assemblies 8*a* are often attached to drum 6 in staggered rows. It is typical for each drum to be provided with 50 or more pick assemblies but it is possible for there to be fewer than 50 pick assemblies.

FIGS. 2 to 5 illustrates a typical pick 10*a* and pick assembly 8*a* in common use. Pick 10*a* has a non-circular shank 22*a* having a linear rectangular transverse cross section adapted to be releasably located within a corresponding opening 14*a* in a holder 12*a*. The front or leading face 31*a* of the shank 22*a* is optionally provided with a blind aperture 27*a* to receive a resilient, shank retaining button (not shown). From the upper end of the leading face 31*a* of the shank 22*a*, a forwardly directed shoulder 30*a* extends having an underside surface 41*a* to seat on a top bearing surface 51*a* of the associated holder 12*a* in the well-known manner. Further forward, the shoulder 30*a* is provided with a pry point 16*a* for engagement by a removal tool. At trailing face 32*a* of the shank 22*a* is provided a heel 25*a* also having a support surface 42*a*, and in addition a duct 18*a* to accommodate a portion of a water spray (not shown). Beyond the shoulder 30*a* and heel 25*a* extends an integral blade 23*a* provided with a carbide tip 24*a*. Shoulder 30*a*, heel 25*a* and blade 23*a* comprise the head 20*a* of the pick 10*a*.

The shank 22*a* is releasably retained in the holder 12*a* against inadvertent loss by a securement mechanism 19*a*, such as a multi-ribbed, synthetic plastic insert. Numerous other types of pick latching devices are widely known such as those disclosed in GB Patent 1,579,105, U.S. Pat. No. 4,261,619, U.S. Pat. No. 4,154,483, and US Patent Publication No. 2014-0175853. The securement mechanism 19*a* is inserted into an aperture 26*a* of the pick 10*a*. The pick 10*a* with the securement mechanism 19*a* is then inserted into the opening 14*a* within the holder 12*a* and pushed downward until ribs 71*a* on the securement mechanism engage corresponding ribs 81*a* on the holder.

Eventually, as the pick 10*a* engages the earthen material 9 to be extracted, the pick 10*a* will wear out or break and need replacement. When the pick 10*a* needs replacement, a removal tool, such as a pry bar or drift, will be used to engage the pry point 16*a* on pick 10*a* and the corresponding surface 90*a* on the holder 12*a* below the pry point 16*a*. As the removal tool bears against the pry point 16*a* and the corresponding surface 90*a* on the tool holder 12*a*, the pick 10*a* is pried out of the opening 14*a* in the holder 12*a* (i.e., the pick 10*a* is pried upwards until the ribs 71*a* on the securement mechanism 19*a* are disengaged from the ribs 81*a* on the holder). Because the pry point 16*a* is located forward of the axis A1 of the shank 22*a*, the shank 22*a* tends to bear against the opening 14*a* when the pick 10*a* is pried out of the holder 12*a* (i.e., the trailing face 32*a* of the shank 22*a* tends to bear against the rear wall 21*a* of the opening 14*a* in the holder 12*a*). This increases the force required to remove the pick 10*a* from the holder 12*a*.

In accordance with the invention shown in FIGS. 6-26, pick assembly 8 includes a holder 12, a pick 10, and at least one securement mechanism 19 to secure the pick 10 to the holder 12. The Pick 10 has a plurality of removal features 60 that can be engaged with a removal tool T to remove the pick 10 from the holder 12. Pick 10 and holder 12 may have a variety of different shapes and may, for example, be similar to the standard pick shown in FIGS. 1-5 or may be similar to the picks disclosed in US Patent Publication No. 2014-0368022, which is incorporated herein by reference in its entirety. For ease of discussing the invention, pick 10 and holder 12 are shown as having a similar shape as the pick and holder disclosed in US Patent Publication No. 2014-0368022, but it should be appreciated that the inventive removal features 60 may be used on a pick and holder having a shape other than the pick and holder shown in US Patent Publication No. 2014-0368022. The removal features 60 may be used on a variety of picks having a variety of shapes and sizes, and a variety of securement mechanisms.

In the illustrated embodiment, pick 10 has a non-circular shank 22 having a generally diamond shaped transverse cross section adapted to be releasably located within a corresponding opening 14 in the holder 12. Although the shank is preferably diamond shaped other shapes are possible such as a shank that is generally rectangular or circular. From the upper end of the leading face 31 of the shank 22, a forwardly directed shoulder 30 extends having V-shaped underside bearing surfaces 41 to seat on a top bearing surfaces 51 of the associated holder 12. Although the underside bearing surfaces 41 are preferably V-shaped they may have a shape other than V-shaped and may, for example, be flat. Beyond the shoulder 30 extends an integral blade 23 provided with a carbide tip 24. Shoulder 30 and blade 23 comprise the head 20 of the pick 10. Pick 10 is shown as being free of a rear heel, but may in some embodiments have a rear heel.

The shank 22 is shown as being generally straight and having a rearward inclination as disclosed in US Patent Publication No. 2014-0368022. While it is preferred that the shank have a rearward inclination, the shank may not have a rearward inclination and may have no inclination or may have a forward inclination. Further, the shank may not be generally straight and may, for example, have a C-shaped hook.

The shank 22 is releasably retained in the holder 12 against inadvertent loss by at least one securement mechanism 19, such as a multi-ribbed, synthetic plastics insert. Securement mechanisms can be, for example, as disclosed in GB Patent 1,579,105, U.S. Pat. No. 4,261,619, U.S. Pat. No. 4,154,483, US Patent Publication No. 2014-0175853, and US Patent Publication No. 2014-0368022, each of which is incorporated herein by reference in its entirety. While the securement mechanism 19 is illustrated as a multi-ribbed synthetic plastic insert, securement mechanism 19 may be a pin or alternative lock known to secure picks to holders.

Securement mechanism 19 is shown as being held within an aperture 26 in the side of the shank 22. Aperture 26 is generally concentric with the center of rotation C of the pick 10 within the holder 12. Although the securement mechanisms are preferably located in apertures as described above, alternative locations are possible; for example, an aperture may be located above the center of rotation C or may be located on the leading or front surface of the shank and/or the trailing or rear surface of the shank. In addition, the shank may not have an aperture and the securement mechanism may engage the pick in an alternative fashion. Aperture 26 is shown as generally circular but the shape of the aperture may be a shape other than circular and may, for example, be a double "O" aperture as is well known in the art, or may be square, oval, or another shape that is well known in the art. Aperture 26 is shown as generally matching the shape of securement mechanism 19 but this is not a requirement and the aperture may have a shape that does not generally match the shape of the securement mechanism. The inventive removal features are not dependent on using any particular kind of securement mechanism or having the securement mechanism at any particular location; the invention is usable with a wide range of securement mechanisms.

A plurality of removal features 60 are shown on each side of the pick 10. In an alternative embodiment of the invention not shown, only one side of the pick will have removal features 60. In another alternative embodiment of the invention not shown, one removal feature will be provided on one of the sides of the pick and a second removal feature will be provided that is linearly offset along the axis of the shank and located on an opposite sides of the pick. In another alternative embodiment of the invention not shown, the removal features may be on the leading side 31 of the pick or the trailing side 32 of the pick 10.

In the illustrated embodiment, each removal feature 60 has a pry surface and a recess 64 directly below the pry surface. Each recess 64 provides sufficient clearance for tool T to engage the pry surface and use each removal feature 60 for moving the pick out of the holder. The pry surfaces are preferably on the head (and/or top portion of the shank) for easy access by a pry tool and to use upper walls of the holder as a fulcrum bearing surface for the pry tool. The pry surfaces are preferably within or along a longitudinal extension of the shank even when located on the head to lessen canting of the pick during removal. The typical pry surface 16*a* (FIG. 3) is forward and outside of the longitudinal extension of the shank, which can lead to more canting of the pick during removal and more difficulty in removing the pick from the opening. Having successive pry surfaces within the shank extension and generally parallel to and along the longitudinal axis of the shank increases the effectiveness of the removal operation.

The removal features 60 are shown being preferably recessed into the side of the pick so that the removal features do not interfere with the insertion or removal of the pick 10 in the holder 12. In an alternative embodiment of the invention, not shown, the removal features may protrude from the pick without interfering with the insertion of the pick within the holder, and it may not be necessary for a recess to be located directly below each removal feature.

Each removal feature 60 is preferably generally perpendicular to the axis A of the shank 22 of the pick 10 (FIG. 16) to provide stable surfaces for the pry tool but other orientations are possible. The removal features are preferably collectively aligned generally parallel with the axis of the shank 22 of the pick 10 (FIG. 15). Other arrangements are possible.

Removal features 60 are shown as all having generally the same shape and all being a generally planer bearing surface 62. In an alternative embodiment of the invention not shown, other shapes are possible and the removal features may not be a planer bearing surface and each removal feature may not have the same shape.

Three removal features 60 are shown on each side of the pick 10. In an alternative embodiment of the invention not shown, the pick may have more than three removal features or less than three removal features on each side of the pick. In the illustrated embodiment, each removal feature 60 is successive. The removal features 60 are in-line and successive so that the operator can engage one removal feature one after the other. The tool T can engage a single bearing surface 90 on the holder to remove the pick from the holder. In an alternative embodiment of the invention, not shown, the removal features may not be successive or the operator may be required to move the removal tool from a first bearing surface on the holder to a second bearing surface on the holder to remove the pick from the holder.

Figure 11:
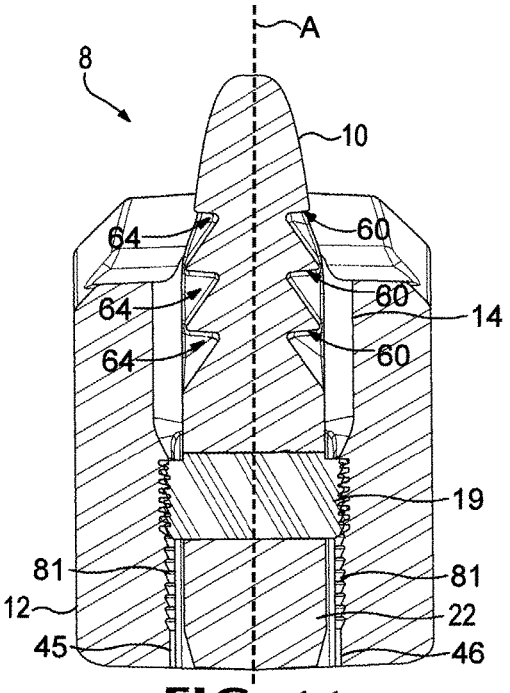
FIG. 11 is a cross sectional view of the pick assembly shown in FIG. 6 taken along line 11-11 in FIG. 10.
Figure 12:
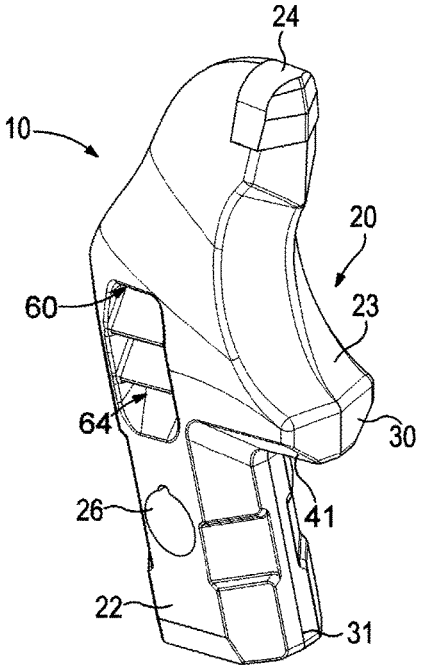
FIG. 12 is a front perspective view of the pick shown in FIG. 6.
Figure 13:
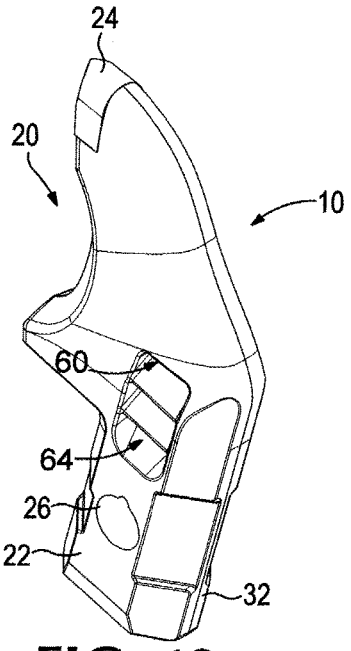
FIG. 13 is a rear perspective view of the pick shown in FIG. 6.
Figure 14:
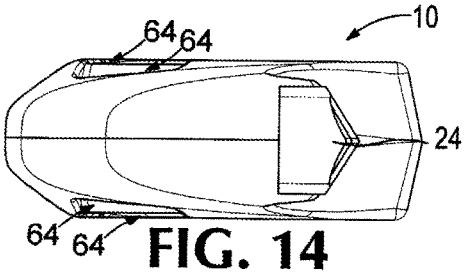
FIG. 14 is a top view of the pick shown in FIG. 6.
Figure 19:
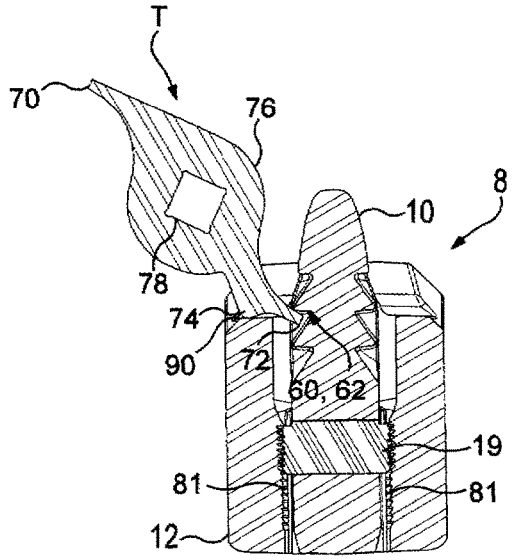
FIG. 19 is a cross sectional view of the removal tool initially engaging the first removal feature on the pick assembly shown in FIG. 6 taken along line 19-19 in FIG. 18.

The pick 10 is shown as having one removal feature 60 on each side of the pick that is recessed within opening 14 of holder 12 when the pick 10 is fully seated within the holder 12 (FIGS. 11 and 19). In an alternative embodiment of the invention, not shown, the pick may have more than one or may have no removal feature recessed within opening 14 of holder 12.

Pick 10 is shown as having two removal features 60 on each side of the pick 10 that are outside of opening 14 of holder 12 when the pick 10 is fully seated within the holder 12 (FIGS. 11 and 19). In an alternative embodiment of the invention, not shown, the pick may have more than two or less than two removal features outside of opening 14 of holder 12 when pick 10 is fully seated within holder 12. In the illustrated embodiment, the uppermost removal features 60 are only designed to be engaged with a removal tool T once the holder 12 has been worn such that the pick 10 rests lower within the holder 12. In an alternative embodiment of the invention, not shown, the pick may not have a removal feature provided specifically for worn holders or the pick may have more than one removal feature that is only engaged with a removal tool once the holder has been worn.

The holder 12 has a mounting surface 15 for mounting the holder to the drum 6 and an opening 14 for receiving the pick 10. The upper end of the leading face of the holder 12 has top bearing surfaces 51 for supporting and bearing against underside surfaces 41 of shoulder 30 on pick 10. In some embodiments, holder 12 will have a rear opening (not shown) for receiving a water spray (not shown).

Opening 14 is non-circular having a generally diamond shaped cross section adapted to receive shank 22 that generally matches the shape of opening 14. Although the opening 14 is preferably generally diamond shaped other shapes are possible such as a shank that is generally square or circular. The opposing side surfaces 46 and 45 of the opening 14 are provided with a retaining feature 81 for engaging the securement mechanism 19. While both side surfaces 46 and 45 are shown as having a retaining feature 81, other embodiments include only one of the side surfaces 46 or 45 provided with a retaining feature 81 and/or a retaining feature on the front or rear wall of opening 14.

Retaining feature 81 is shown as being in the form of ribs, although other retaining features are possible as is known in the art. Additionally, the retaining feature may be a transverse bore within the holder as is disclosed in GB Patent 2,420,360 or GB Patent 1,539,347 such that the securement mechanism engages the interior surface of the opening to maintain the pick within the holder. The retaining feature 81 preferably extends along a substantial portion of the length of the opening 14, although the retaining features may only extend a small portion of the opening.

Holder 12 has bearing surfaces 90 for engaging a removal tool to remove pick 10 from holder 12. Bearing surfaces 90 are shown as being planer surfaces that have a forward inclination. However, bearing surfaces 90 could have other configurations such that they are not planer and/or do not have a forward inclination. Preferably bearing surfaces 90 are generally parallel to removal feature 60 on pick 10 when the pick 10 is seated in the holder 12. In an alternative embodiment of the invention, not shown, the holder may have only one bearing surface or may have more than two bearing surfaces for engaging the removal tool. In the illustrated embodiment, each bearing surface 90 is shown as being a part of a top portion of the holder. In an alternative embodiment of the invention, not shown, the bearing surfaces may be recessed in a side of the holder such that a tool accesses the removal features through a second hole that extends from an exterior surface of the holder to the opening in the holder that receives the shank of the pick. In an alternative embodiment of the invention, not shown, a removal tool and pick may be provided that does not require the holder to have bearing surfaces to remove the pick from the holder. For example, a pick may be provided with multiple removal features that may be engaged with a tool that pulls or pushes the pick out of a holder without prying the tool against the holder.

Figure 26:
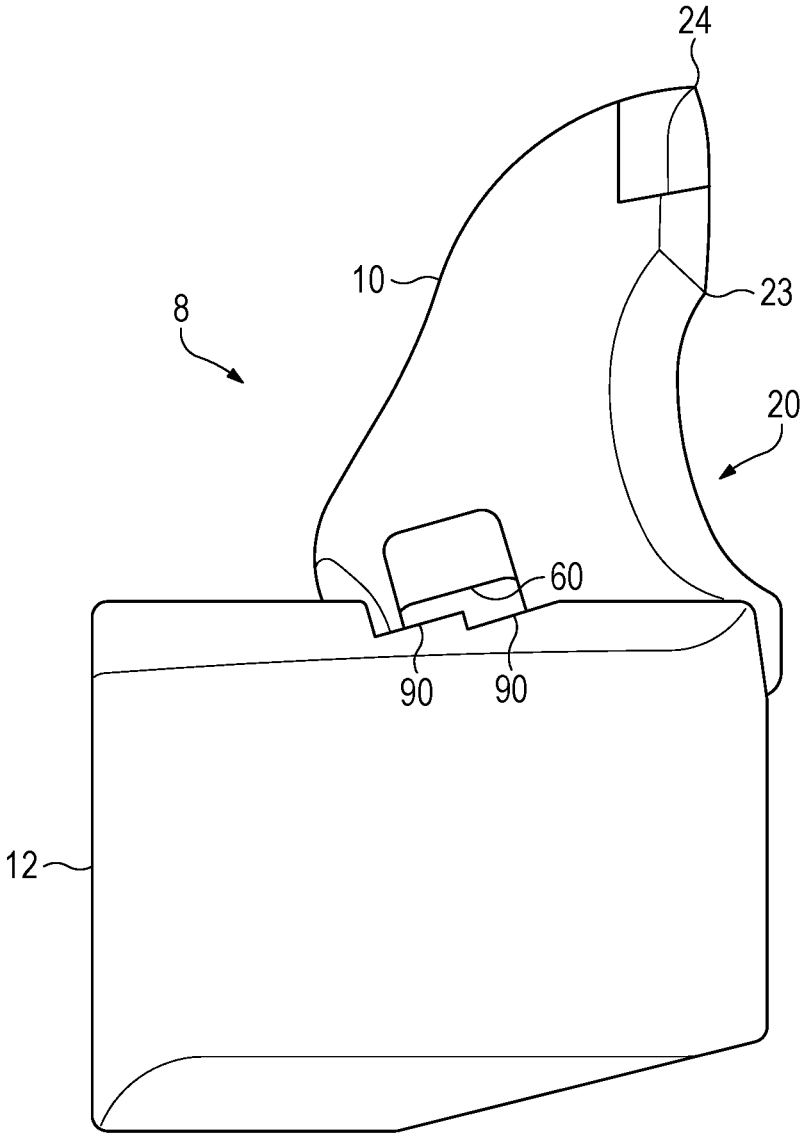
FIG. 26 is a side view illustrating another example pick and holder combination in accordance with the disclosure.

FIG. 26 is a side view illustrating another example pick and holder combination in accordance with the present disclosure. An elongate shank on the pick may be configured to fit into a hole defined in the holder. A first fulcrum and pry point combination may be disposed to enable a first translational movement of the pick from the holder; and a second fulcrum and pry point combination may be disposed to enable a second translational movement of the pick from the holder. In this example, the first fulcrum and pry point combination includes a first fulcrum surface 90 on the holder 12 to receive a pry tool and to function as a first fulcrum to enable the pry tool to hook under a notch 60 defined on the shank. A second fulcrum and pry point combination in this example includes a second fulcrum surface 90 on the holder 12 to receive the pry tool and to function as a second fulcrum to enable the pry tool to hook under the notch 60. The second fulcrum surface 90 is located a further longitudinal distance from the notch 60 than the first fulcrum surface 90. In this way, the removal tool may first be positioned on the first, lower fulcrum surface to enable a first translational movement of the pick 10, and then the removal tool may be positioned on the second relatively higher fulcrum surface 90 to enable a second translational movement of the pick 10.

In some cases, the mineral pick and pick holder combination may include an additional row of notches defined on the shank of the pick 10 (i.e., side-by-side removal features) that may also be disposed to enable the pry tool to hook thereunder while either the first or the second fulcrum surfaces 90 may function as a fulcrum to enable a translational movement of the pick 10 from the holder 12. This additional row of removal features could be in lieu of the multiple bearing surfaces 90 on the holder or in addition to them.

A removal tool T is provided for removing the pick 10 from the holder 12. Removal tool T is provided with a first pry end 70 and a second pry end 72. Either one of pry ends 70 or 72 may be used to engage bearing surface 90 and removal features 60 to remove the pick 10 from the holder 12. The first and second pry ends 70 and 72 have a generally wedge shape similar to those known in the art for pry bars and drifts. Adjacent the second pry end 72 a rounded protrusion 74 is provided. Rounded protrusion 74 provides extra leverage to pry the pick 10 out of the holder 12. The first and second pry ends 70 and 72 are joined together with a generally circular body 76. Circular body 76 has an opening 78 for inserting a standard tool such as a ratchet, wrench, and/or breaker bar (not shown). Other removal tools such as standard and custom pry bars and drifts may also be used to remove pick 10 from holder 12.

Figure 18:
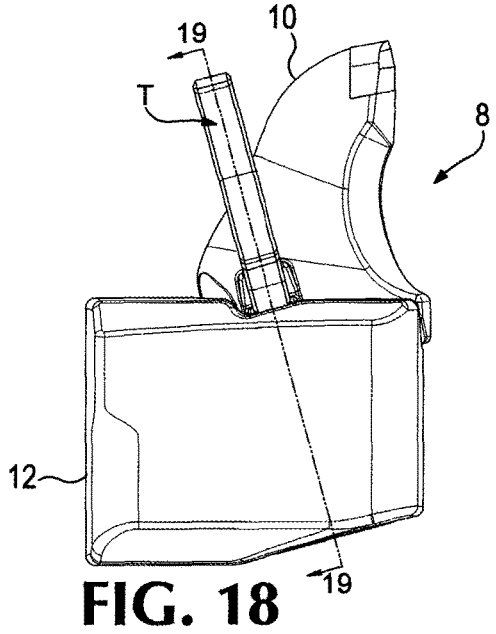
FIG. 18 is a side view of a removal tool initially engaging a first removal feature on the pick assembly shown in FIG. 6.
Figure 20:
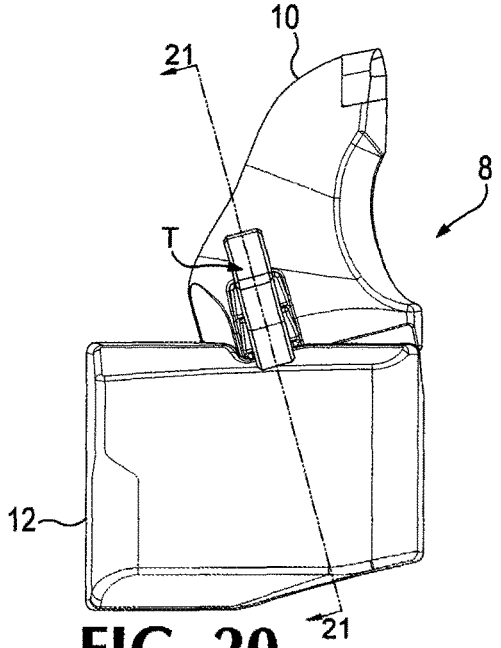
FIG. 20 is a side view of the removal tool engaging the first removal feature to partially disengage the pick from the holder shown in FIG. 6.
Figure 21:
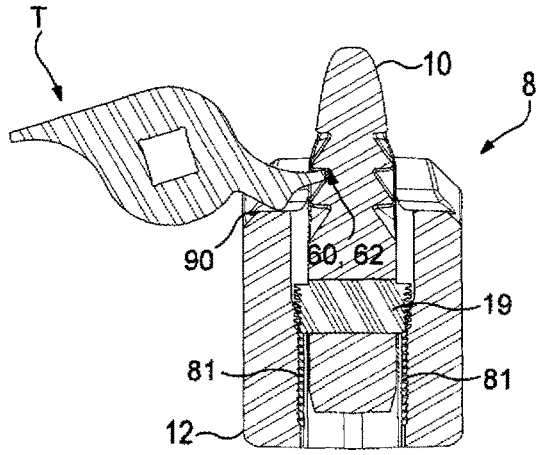
FIG. 21 is a cross sectional view of the removal tool engaging the first removal feature to partially disengage the pick from the holder shown in FIG. 6 taken along line 21-21 in FIG. 20.
Figure 22:
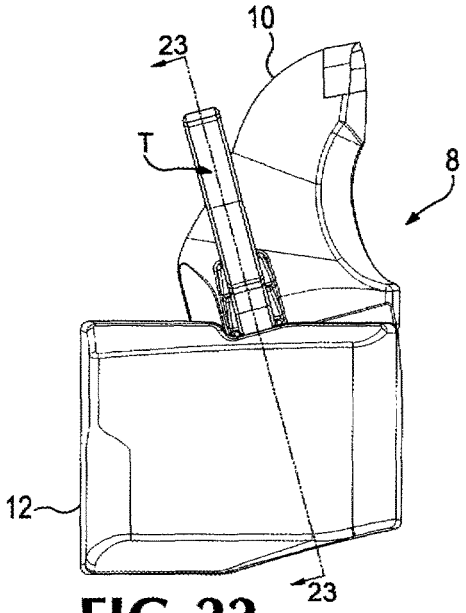
FIG. 22 is a side view of the removal tool initially engaging a second removal feature on the pick assembly shown in FIG. 6.
Figure 23:
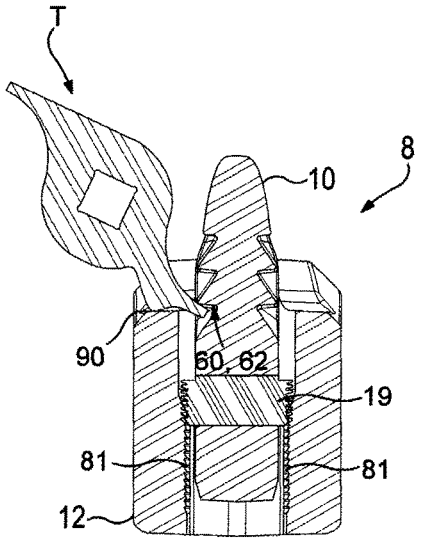
FIG. 23 is a cross sectional view of the removal tool initially engaging the second removal feature on the pick assembly shown in FIG. 6 taken along line 23-23 in FIG. 22.
Figure 24:
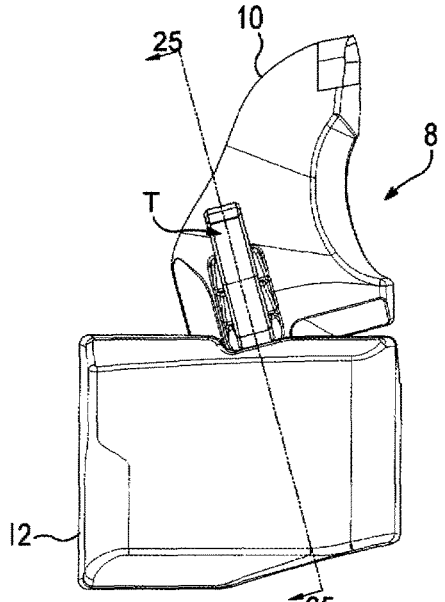
FIG. 24 is a side view of the removal tool engaging the second removal feature to completely disengage the pick from the holder shown in FIG. 6.
Figure 25:
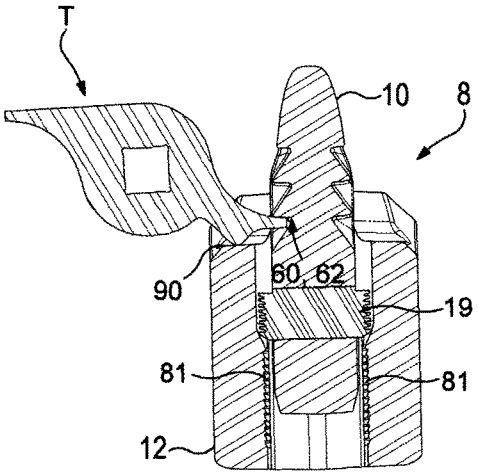
FIG. 25 is a cross sectional view of the removal tool engaging the second removal feature to completely disengage the pick from the holder shown in FIG. 6 taken along line 25-25 in FIG. 24.

In use, an operator inserts the removal tool T between the holder 12 and the pick 10 so that the removal tool T bears against bearing surface 90 and a first bearing surfaces 62 of a first removal feature 60 (FIGS. 18 and 19). The operator moves the removal tool T in a downward direction to move the pick in an upward direction (FIGS. 20 and 21). The operator then moves the removal tool T to a second removal feature 60 so that the tool bears against bearing surface 90 and a second bearing surface 62 of the second removal feature 60 (FIGS. 22 and 23). The operator moves the removal tool T in a downward direction to again move the pick in an upward direction (FIGS. 24 and 25). The operator continues to engage the bearing surfaces 62 and 90 until the securement mechanism 19 is fully separated from the retaining feature 81. By providing the removal features on a sidewall generally aligned with the axis of the shank (i.e., the insertion direction of the shank into the holder), canting of the pick during removal is lessened.

Embodiments may provide a method of removing a pick from a pick holder. The method may include positioning a removal tool into a first position wherein a fulcrum point of the removal tool bears against a first bearing surface on the holder and a first end of the removal tool bears against a first removal feature on a shaft of the pick. The method may also include applying an input force to a second end of the removal tool in a first direction thereby causing an output force to be exerted in a second direction by the first end on the removal tool causing the pick to move a first translational distance relative to the holder. The method may also include repositioning the removal tool into a second position. The repositioning may be performed wherein the fulcrum point of the removal tool bears against the first bearing surface on the holder and the first end of a removal tool bears against a second removal feature on a shaft of the pick. Alternatively the repositioning may be performed wherein the fulcrum point of the removal tool bears against a second bearing surface on the holder and the first end of a removal tool bears against the first removal feature on a shaft of the pick.

In some cases the method may also include applying an additional input force to the second end of the removal tool in the first direction thereby causing an additional output force to be exerted in a second direction by the first end on the removal tool causing the pick to move a second translational distance relative to the holder.

In some cases the method may also include repeating the repositioning of the removal tool and the applying a force step until the pick is one or more of: removed from the holder, free to be manually removed from the holder, and until a securement mechanism coupled with the shaft is fully separated from a retaining feature on the holder.

The topmost pry surface may be positioned higher than optimal for leveraged removal when the pick and holder is first installed. However, use and consequent wear may cause the pick to ride relatively lower in the pick seat. Accordingly, the height of the topmost pry surface may become better positioned after use. The top notch may be used to initially pry the pick from the tool holder. Once the next notch is accessible it can be used to further pry the pick from the holder. The above steps may be repeated until the pick is disengaged from the holder.

The above disclosure describes specific examples of a pick and holder with multiple removal features that can be engaged to remove the pick from the holder. The holder, pick, and pick assembly include different aspects or features of the invention. The features in one embodiment can be used with features of another embodiment. The examples given and the combination of features disclosed are not intended to be limiting in the sense that they must be used together.

The invention claimed is:

1. A pick and holder combination comprising:

a holder having an opening therein; and a pick including a head with a working end to contact the ground and a mounting end having a bearing surface to contact the holder, and a shank configured to fit into the opening;

two or more pry features, at least one said pry feature being accessible to receive a pry tool when the pick is fully seated in the holder to pry the pick at least partway from the opening using one of the pry features, and to pry the pick further from the opening using another of the pry features, each of the pry features including a removal surface, and the holder including a fulcrum surface parallel to the removal surfaces, wherein at least one of the pry features is below the fulcrum surface when the pick is fully seated in the opening of the holder.

2. The pick and holder combination of claim 1, wherein the two or more pry features are provided on two oppositely disposed sides of the shank.

3. The pick and holder combination of claim 1, wherein the shank extends outward from the head along a longitudinal axis, and each of the two or more pry features are in a longitudinally offset position relative to the other of the two or more pry features.

4. The pick and holder combination of claim 3, wherein the two or more pry features are aligned generally parallel with the longitudinal axis of the shank.

* * * * *